US011815852B2

(12) United States Patent
Cohen et al.

(10) Patent No.: US 11,815,852 B2
(45) Date of Patent: Nov. 14, 2023

(54) LIQUID ELECTROPHOTOGRAPHIC INK COMPOSITION

(71) Applicant: Hewlett-Packard Development Company, L.P., Spring, TX (US)

(72) Inventors: Eyal Cohen, Nes Ziona (IL); Albert Teishev, Nes Ziona (IL); Reut Avigdor, Nes Ziona (IL); Yael Kowal-Blau, Nes Ziona (IL); Tal Rosenthal, Nes Ziona (IL); Anatoly Sobolevsky, Nes Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 226 days.

(21) Appl. No.: 16/956,150

(22) PCT Filed: Apr. 17, 2018

(86) PCT No.: PCT/US2018/027914
§ 371 (c)(1),
(2) Date: Jun. 19, 2020

(87) PCT Pub. No.: WO2019/203803
PCT Pub. Date: Oct. 24, 2019

(65) Prior Publication Data
US 2020/0341401 A1 Oct. 29, 2020

(51) Int. Cl.
*G03G 9/13* (2006.01)

(52) U.S. Cl.
CPC ..... *G03G 9/131* (2013.01)

(58) Field of Classification Search
CPC ..... G03G 9/131
See application file for complete search history.

(56) References Cited

U.S. PATENT DOCUMENTS

| | | | |
|---|---|---|---|
| 3,405,683 | A | 10/1968 | Kurt et al. |
| 3,900,003 | A | 8/1975 | Sato et al. |
| 4,073,266 | A | 2/1978 | Ameth et al. |
| 4,241,159 | A | 12/1980 | Priem et al. |
| 4,342,823 | A | 8/1982 | Grant et al. |
| 4,400,079 | A | 8/1983 | Landa |
| 4,504,138 | A | 3/1985 | Kuehnle et al. |

(Continued)

FOREIGN PATENT DOCUMENTS

| | | |
|---|---|---|
| CN | 101575397 | 12/2011 |
| CN | 103391978 A | 11/2013 |

(Continued)

OTHER PUBLICATIONS

Tao et al., Study on Preparation and Property of Acrylic Resins Used for Water-based Ink, Applied Mechanics and Materials, vol. 262, 2013, pp. 491-496.

(Continued)

*Primary Examiner* — Peter L Vajda
*Assistant Examiner* — Boone Alexander Evans
(74) *Attorney, Agent, or Firm* — HP Inc. Patent Department

(57) ABSTRACT

Herein is described a liquid electrophotographic ink composition including a carrier liquid and a resin including an acid copolymer and an acrylate copolymer, wherein the acrylate copolymer includes at least about 30 wt. % of the alkyl (meth)acrylate monomer.

13 Claims, 2 Drawing Sheets

(56) References Cited

U.S. PATENT DOCUMENTS

| | | | | |
|---|---|---|---|---|
| 4,690,539 | A | 9/1987 | Radulski et al. | |
| 5,106,417 | A | 4/1992 | Hauser et al. | |
| 5,270,368 | A | 12/1993 | Lent et al. | |
| 5,749,032 | A | 5/1998 | Landa et al. | |
| 2002/0197550 | A1* | 12/2002 | Livengood ..... | G03G 9/08742 430/108.4 |
| 2013/0323636 | A1 | 12/2013 | Bar-Haim et al. | |
| 2015/0118448 | A1* | 4/2015 | Stolin Roditi ..... | G03G 7/00 430/113 |
| 2015/0323879 | A1* | 11/2015 | Kabalnov ..... | G03G 9/1355 428/207 |

FOREIGN PATENT DOCUMENTS

| | | |
|---|---|---|
| KR | 1020110008037 | 1/2011 |
| KR | 20130116881 | 10/2013 |
| KR | 20150042228 | 4/2015 |
| WO | 2008054386 | 5/2008 |
| WO | 2013159820 | 10/2013 |
| WO | 2013188746 | 12/2013 |
| WO | 2016048343 | 3/2016 |
| WO | 2016/116142 A1 | 7/2016 |
| WO | 2018014962 | 1/2018 |

OTHER PUBLICATIONS

International Search Report dated Jan. 10, 2019 for PCT/US2018/027914, Applicant Hewlett-Packard Development Company, L.P.

* cited by examiner

LIQUID ELECTROPHOTOGRAPHIC INK COMPOSITION

BACKGROUND

Electrophotographic printing processes, sometimes termed electrostatic printing processes, typically involve creating an image on a photoconductive surface, applying an ink having charged particles to the photoconductive surface, such that they selectively bind to the image, and then transferring the charged particles in the form of the image to a print substrate.

The photoconductive surface may be on a cylinder and is often termed a photo imaging plate (PIP). The photoconductive surface is selectively charged with a latent electrostatic image having image and background areas with different potentials. For example, an electrophotographic ink composition including charged toner particles in a liquid carrier can be brought into contact with the selectively charged photoconductive surface. The charged toner particles adhere to the image areas of the latent image while the background areas remain clean. The image is then transferred to a print substrate directly or, by being first transferred to an intermediate transfer member, which can be a soft swelling blanket, which is often heated to fuse the solid image and evaporate the liquid carrier, and then to the print substrate.

DETAILED DESCRIPTION

Figure 1:
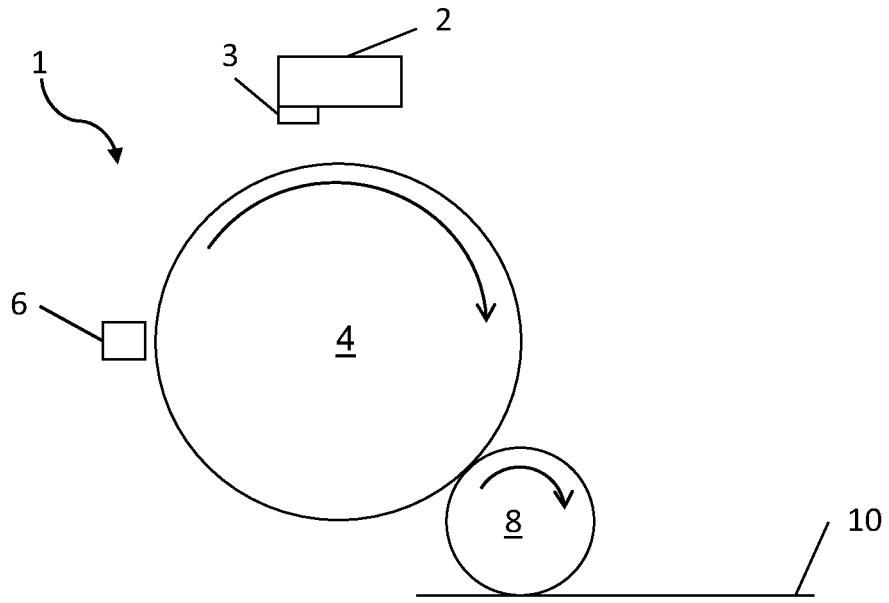
FIG. 1 is a schematic illustration of an example of a Liquid Electro Photographic (LEP) printing apparatus for printing a liquid electrophotographic ink composition.
Figure 2:
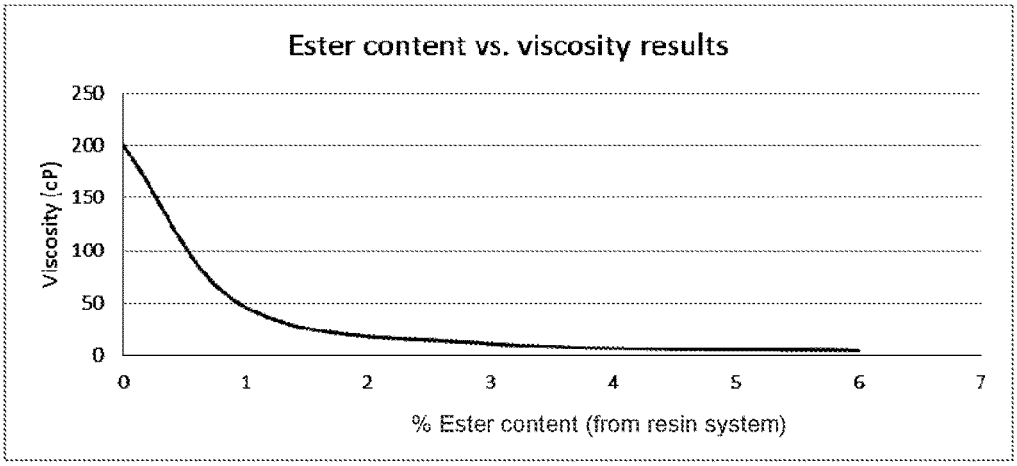
FIG. 2 is a graph showing the viscosity of liquid electrophotographic ink compositions comprising Isopar L and a resin comprising F:ACE (80:20 wt./wt.) and 0, 1, 3 and 6 wt. % (by total resin content) of ELV35 at 8.4 wt. % NVS.

Before the compositions, methods and related aspects of the disclosure are disclosed and described, it is to be understood that this disclosure is not restricted to the particular process features and materials disclosed herein because such process features and materials may vary somewhat. It is also to be understood that the terminology used herein is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid", "carrier," or "carrier vehicle" refers to the fluid in which the polymer resin, pigment, charge directors and/or other additives can be dispersed to form a liquid electrostatic ink or electrophotographic ink. Liquid carriers can include a mixture of a variety of different agents, such as surfactants, co-solvents, viscosity modifiers, and/or other possible ingredients.

As used herein, "electrophotographic ink composition" or "electrostatic ink composition" generally refers to an ink composition, which may be in liquid form, generally suitable for use in an electrostatic printing process, sometimes termed an electrophotographic printing process. The electrophotographic ink composition may include chargeable particles of the resin (e.g. resin and pigment) dispersed in a liquid carrier, which may be as described herein.

As used herein, "co-polymer" refers to a polymer that is polymerized from at least two monomers.

Unless otherwise stated, viscosity (dynamic viscosity) was measured using an AR-2000 model Rheometer from TAI (Thermal Analysis Instruments)). The rheometer is used as a viscometer, by applying shear forces on the testing sample between two parallel plates. The sample is loaded between parallel plates at a known gap with a continuous random ramp shear rate of 0.1 $s^{-1}$ to 3000 $s^{-1}$ at a temperature of 25° C. and measurements are taken at a shear rate of approximately 11 $s^{-1}$.

As used herein, "melt flow rate" generally refers to the extrusion rate of a resin through an orifice of defined dimensions at a specified temperature and load, usually reported as temperature/load, e.g. 190° C./2.16 kg. Flow rates can be used to differentiate grades or provide a measure of degradation of a material as a result of molding. In the present disclosure, "melt flow rate" is measured per ASTM D1238-04c Standard Test Method for Melt Flow Rates of Thermoplastics by Extrusion Plastometer. If a melt flow rate of a particular polymer is specified, unless otherwise stated, it is the melt flow rate for that polymer alone, in the absence of any of the other components of the electrophotographic ink composition.

As used herein, "acidity," "acid number," or "acid value" refers to the mass of potassium hydroxide (KOH) in milligrams that neutralizes one gram of a substance. The acidity of a polymer can be measured according to standard techniques, for example as described in ASTM D1386. If the acidity of a particular polymer is specified, unless otherwise stated, it is the acidity for that polymer alone, in the absence of any of the other components of the liquid toner composition.

As used herein, "melt viscosity" generally refers to the ratio of shear stress to shear rate at a given shear stress or shear rate. Testing is generally performed using a capillary rheometer. A plastic charge is heated in the rheometer barrel and is forced through a die with a plunger. The plunger is pushed either by a constant force or at constant rate depending on the equipment. Measurements are taken once the system has reached steady-state operation. One method used is measuring Brookfield viscosity @ 140° C., units are mPa·s or cPoise. In some examples, the melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate. If the melt viscosity of a particular polymer is specified, unless otherwise stated, it is the melt viscosity for that polymer alone, in the absence of any of the other components of the electrophotographic composition.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic(ally) printing" or "electrophotographic(ally) printing" generally refers to the process that provides an image that is transferred from a photo imaging substrate or plate either directly or indirectly via an intermediate transfer member to a print substrate, e.g. a paper substrate. As such, the image is not substantially absorbed into the photo imaging substrate or plate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrophotographic ink composition to an electric field, e.g. an electric field having a field strength of 1000 V/cm or more, in some examples 1000 V/mm or more.

As used herein, the term "about" is used to provide flexibility to a numerical range endpoint by providing that a given value may be a little above or a little below the endpoint. The degree of flexibility of this term can be dictated by the particular variable.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the end points of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

As used herein, unless specified otherwise, wt % values are to be taken as referring to a weight-for-weight (w/w) percentage of solids in the ink composition, and not including the weight of any carrier fluid present.

Unless otherwise stated, any feature described herein can be combined with any aspect or any other feature described herein.

In an aspect there is provided a liquid electrophotographic (LEP) ink composition. The LEP ink composition may comprise:

a carrier liquid; and a resin comprising:

an acid copolymer of an alkylene monomer and a monomer having an acid side group; and at least about 0.1 wt. % by total weight of the resin of an acrylate copolymer of an alkylene monomer and an alkyl (meth)acrylate monomer, the acrylate copolymer comprising at least about 30 wt. % of the alkyl (meth) acrylate monomer.

In another aspect there is provided a method of producing a liquid electrophotographic (LEP) ink composition. The method may comprise combining a carrier liquid and a resin to form a mixture, the resin comprising:

an acid copolymer of an alkylene monomer and a monomer having an acid side group; and at least about 0.1 wt. % by total weight of the resin of an acrylate copolymer of an alkylene monomer and an alkyl (meth)acrylate monomer, the acrylate copolymer comprising at least about 30 wt. % of the alkyl (meth) acrylate monomer.

In another aspect there is provided a printed substrate. The printed substrate may comprise a print substrate and a liquid electrophotographically printed image layer comprising a resin comprising:

an acid copolymer of an alkylene monomer and a monomer having an acid side group; and at least about 0.1 wt. % by total weight of the resin of an acrylate copolymer of an alkylene monomer and an alkyl (meth)acrylate monomer, the acrylate copolymer comprising at least about 30 wt. % of the alkyl (meth) acrylate monomer.

The present inventors have found that providing a LEP ink composition comprising a resin comprising an acid copolymer and an acrylate copolymer as described herein, provides a composition with a reduced viscosity compared to conventional LEP ink compositions which allows the solids content of the LEP ink composition to be increased. Additionally, the compositions described herein have surprisingly been found to show improvements in extraction and durability of images printed from the LEP ink compositions.

Liquid Electrophotographic Ink Composition

The liquid electrophotographic (LEP) ink composition comprises a carrier liquid and a resin.

Resin

The resin comprises an acid copolymer and an acrylate copolymer.

Acid Copolymer

The acid copolymer is a copolymer of an alkylene monomer and a monomer having an acid side group. In some examples the alkylene monomer is an ethylene or a propylene monomer. In some examples, the monomer having an acid side group is an acrylic acid monomer or a methacrylic acid monomer. In some examples, the acid copolymer is a copolymer of an alkylene monomer and a (meth)acrylic acid monomer (i.e. a monomer selected from acrylic acid and methacrylic acid).

In some examples, the acid copolymer has an acidity of 50 mg KOH/g or more, in some examples an acidity of 60 mg KOH/g or more, in some examples an acidity of 70 mg KOH/g or more, in some examples an acidity of 80 mg KOH/g or more, in some examples an acidity of 90 mg KOH/g or more, in some examples an acidity of 100 mg KOH/g or more, in some examples an acidity of 105 mg KOH/g or more, in some examples 110 mg KOH/g or more, in some examples 115 mg KOH/g or more. In some examples, the acid copolymer has an acidity of 200 mg KOH/g or less, in some examples 190 mg or less, in some examples 180 mg or less, in some examples 130 mg KOH/g or less, in some examples 120 mg KOH/g or less. Acidity of a polymer, as measured in mg KOH/g can be measured using standard procedures, for example using the procedure described in ASTM D1386.

In some examples, the acid copolymer has a melt flow rate of less than about 500 g/10 minutes, less than about 200 g/10 minutes, less than about 100 g/10 minutes, or less than about 90 g/10 minutes. In some examples, the acid copolymer has a melt flow rate of about 80 g/10 minutes or less, 70 g/10 minutes or less, 60 g/10 minutes or less, in some examples about 50 g/10 minutes or less, in some examples about 40 g/10 minutes or less, in some examples 30 g/10 minutes or less, in some examples 20 g/10 minutes or less, in some examples 10 g/10 minutes or less.

In some examples, the acid copolymer has a melt flow rate of about 10 g/10 minutes to about 120 g/10 minutes, in some examples about 10 g/10 minutes to about 70 g/10 minutes, in some examples about 10 g/10 minutes to 40 g/10 minutes, in some examples 20 g/10 minutes to 30 g/10 minutes. In some examples, the acid copolymer has a melt flow rate of about 50 g/10 minutes to about 120 g/10 minutes, in some examples 60 g/10 minutes to about 100 g/10 minutes.

The melt flow rate can be measured using standard procedures, for example as described in ASTM D1238.

The acid side groups may be in free acid form or may be in the form of an anion and associated with one or more counterions, generally metal counterions, e.g. a metal selected from the alkali metals, such as lithium, sodium and potassium, alkali earth metals, such as magnesium or calcium, and transition metals, such as zinc. The acid copolymer can be selected from copolymers of ethylene and an ethylenically unsaturated acid of either acrylic acid or methacrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The acid copolymer can be a copolymer of ethylene and an ethylenically unsaturated acid of either acrylic or methacrylic acid, where the ethylenically unsaturated acid of either acrylic or methacrylic acid constitute from 5 wt % to about 25 wt % of the copolymer, in some examples from 10 wt % to about 20 wt % of the copolymer.

The acid copolymer may comprise two different acid copolymers. The two acid copolymers may have different acidities, which may fall within the ranges mentioned above. The acid copolymer may comprise a first acid copolymer having an acidity of from 50 mg KOH/g to 110 mg KOH/g and a second acid copolymer having an acidity of 110 mg KOH/g to 130 mg KOH/g.

The acid copolymer may comprise two different acid copolymers: a first acid copolymer that has a melt flow rate of about 10 g/10 minutes to about 50 g/10 minutes and an acidity of from 50 mg KOH/g to 110 mg KOH/g, and a second acid copolymer having a melt flow rate of about 50 g/10 minutes to about 120 g/10 minutes and an acidity of 110 mg KOH/g to 130 mg KOH/g. The first and second acid copolymers may be absent of ester groups.

The acid copolymer may comprise two different acid copolymers: a first acid copolymer that is a copolymer of ethylene (e.g. 92 to 85 wt %, in some examples about 89 wt %) and acrylic or methacrylic acid (e.g. 8 to 15 wt %, in some examples about 11 wt %) having a melt flow rate of 80 to 110 g/10 minutes and a second acid copolymer that is a co-polymer of ethylene (e.g. about 80 to 92 wt %, in some examples about 85 wt %) and acrylic acid (e.g. about 18 to 12 wt %, in some examples about 15 wt %), having a melt viscosity lower than that of the first acid copolymer, the second acid copolymer for example having a melt viscosity of 15000 poise or less, in some examples a melt viscosity of 10000 poise or less, in some examples 1000 poise or less, in some examples 100 poise or less, in some examples 50 poise or less, in some examples 10 poise or less. Melt viscosity can be measured using standard techniques. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

In any of the acid copolymers mentioned above, the ratio of the first acid copolymer to the second acid copolymer can be from about 10:1 to about 2:1. In another example, the ratio can be from about 6:1 to about 3:1, in some examples about 4:1.

The acid copolymer may have a melt viscosity of 15000 poise or less, in some examples a melt viscosity of 10000 poise or less, in some examples 1000 poise or less, in some examples 100 poise or less, in some examples 50 poise or less, in some examples 10 poise or less. The acid copolymer may comprise a first acid copolymer having a melt viscosity of 15000 poise or more, in some examples 20000 poise or more, in some examples 50000 poise or more, in some examples 70000 poise or more; and in some examples, the acid copolymer may comprise a second acid copolymer having a melt viscosity less than the first acid copolymer, in some examples a melt viscosity of 15000 poise or less, in some examples a melt viscosity of 10000 poise or less, in some examples 1000 poise or less, in some examples 100 poise or less, in some examples 50 poise or less, in some examples 10 poise or less. The melt viscosity can be measured using a rheometer, e.g. a commercially available AR-2000 Rheometer from Thermal Analysis Instruments, using the geometry of: 25 mm steel plate-standard steel parallel plate, and finding the plate over plate rheometry isotherm at 120° C., 0.01 hz shear rate.

The acid copolymer may comprise two different acid copolymers that are selected from copolymers of ethylene and an ethylenically unsaturated acid of either methacrylic acid or acrylic acid; and ionomers thereof, such as methacrylic acid and ethylene-acrylic or methacrylic acid copolymers which are at least partially neutralized with metal ions (e.g. Zn, Na, Li) such as SURLYN® ionomers. The resin may comprise (i) a first acid copolymer that is a copolymer of ethylene and an ethylenically unsaturated acid of either acrylic acid and methacrylic acid, wherein the ethylenically unsaturated acid of either acrylic or methacrylic acid constitutes from 8 wt % to about 16 wt % of the copolymer, in some examples 10 wt % to 16 wt % of the copolymer; and (ii) a second acid copolymer that is a copolymer of ethylene and an ethylenically unsaturated acid of either acrylic acid and methacrylic acid, wherein the ethylenically unsaturated acid of either acrylic or methacrylic acid constitutes from 10 wt % to about 30 wt % of the copolymer, in some examples from 12 wt % to about 20 wt % of the copolymer, in some examples from 14 wt % to about 19 wt % of the copolymer.

In some examples, the acid copolymer essentially consists of a copolymer of ethylene and methacrylic acid. In some examples the methacrylic acid of the copolymer of ethylene and methacrylic acid constitutes about 8 wt % to about 12 wt % of the copolymer, in some examples about 11 wt. % of the copolymer.

In some examples, the acid copolymer constitutes at least about 50 wt. % by weight of the resin, for example at least about 60 wt. %, at least about 70 wt. %, at least about 80 wt. %, or at least about 90 wt. % by total weight of the resin.

In some examples, the acid copolymer constitutes from about 50 wt. % to about 99.9 wt. % of the resin, for example from about 60 wt. % to about 99 wt. %, from about 70 wt. % to about 99 wt. %, from about 80 wt. % to about 99 wt. %, or from about 90 wt. % to about 99 wt. % of the resin.

Acrylate Copolymer

The acrylate copolymer is a copolymer of an alkylene monomer and an alkyl (meth)acrylate monomer. The acrylate copolymer comprises at least about 30 wt. % of the alkyl (meth)acrylate monomer by total weight of the acrylate copolymer.

In some examples, the alkylene monomer is ethylene or propylene. In some examples, the alkylene monomer is ethylene.

In some examples, the acrylate copolymer comprises at least about 31 wt. % of the alkyl (meth)acrylate monomer by total weight of the acrylate copolymer, in some examples at least about 32 wt. %, in some examples at least about 33 wt. %, in some examples at least about 34 wt. % and in some examples at least about 35 wt. % of the alkyl (meth)acrylate monomer by total weight of the acrylate copolymer.

In some examples, the acrylate copolymer comprises from about 30 wt. % to about 50 wt. % of the alkyl (meth)acrylate monomer by total weight of the acrylate copolymer, in some examples from about 30 wt. % to about 40 wt. %. In some examples, the acrylate copolymer comprises about 35 wt. % of the alkyl (meth)acrylate monomer by total weight of the acrylate copolymer.

In some examples, the acrylate copolymer comprises about 35 wt. % of the alkyl (meth)acrylate monomer by total weight of the acrylate copolymer, with the remaining component of the acrylate copolymer consisting essentially of, or consisting of, the alkylene monomer.

In some examples, the alkyl (meth)acrylate monomer is a C1-C10 alkyl (meth)acrylate monomer. In some examples, the alkyl (meth)acrylate monomer is a C1, C2, C3, C4, C5, or C6 alkyl (meth)acrylate monomer. In some examples, the alkyl (meth)acrylate monomer is a C1-C4 alkyl (meth) acrylate monomer (e.g. C1, C2, C3 or C4). In some examples, the alkyl (meth)acrylate monomer is a butyl (meth)acrylate monomer.

In some examples, the alkyl (meth)acrylate monomer is a alkyl acrylate monomer, for example a C1-C10 alkyl acrylate monomer. In some examples, the alkyl acrylate monomer is a C1, C2, C3, C4, C5, or C6 alkyl acrylate monomer. In some examples, the alkyl acrylate monomer is a C1-C4 alkyl acrylate monomer (e.g. C1, C2, C3 or C4). In some examples, the alkyl acrylate monomer is a butyl acrylate monomer. Mixtures of alkyl isomers are also possible. For example, when the alkyl is butyl, it can be any one of normal, iso- and/or tert-butyl.

In some examples, the acrylate copolymer is a copolymer of ethylene and butyl acrylate. In some examples, the acrylate copolymer comprises about 35 wt. % butyl acrylate.

A suitable commercially available acrylate copolymer is Elvaloy® AC 34035 (Dupont).

In some examples, the acrylate copolymer constitutes at least about 0.1 wt. % by total weight of the resin, for example at least about 0.5 wt. %, or at least about 1 wt. % total weight of the resin. In some examples, the acrylate copolymer constitutes from about 0.1 wt. % to about 10 wt. % by total weight of the resin, for example from about 0.5 wt. % to about 10 wt. %, or from about 1 wt. % to about 10 wt. % by total weight of the resin.

Carrier Liquid

The electrophotographic ink composition may include a liquid carrier. In some examples, the electrophotographic ink composition comprises ink particles including the resin may be dispersed in the liquid carrier. The liquid carrier can include or be a hydrocarbon, silicone oil, vegetable oil, etc. The liquid carrier can include, for example, an insulating, non-polar, non-aqueous liquid that can be used as a medium for ink particles, i.e. the ink particles including the resin and, in some examples, a pigment. The liquid carrier can include compounds that have a resistivity in excess of about $10^9$ ohm·cm. The liquid carrier may have a dielectric constant below about 5, in some examples below about 3. The liquid carrier can include hydrocarbons. The hydrocarbon can include, for example, an aliphatic hydrocarbon, an isomerized aliphatic hydrocarbon, branched chain aliphatic hydrocarbons, aromatic hydrocarbons, and combinations thereof. Examples of the liquid carriers include, for example, aliphatic hydrocarbons, isoparaffinic compounds, paraffinic compounds, dearomatized hydrocarbon compounds, and the like. In particular, the liquid carriers can include, for example, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™ Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

The liquid carrier can constitute about 20% to 99.5% by weight of the LEP ink composition, in some examples 50% to 99.5% by weight of the LEP ink composition. The liquid carrier may constitute about 40 to 90% by weight of the LEP ink composition. The liquid carrier may constitute about 60% to 80% by weight of the LEP ink composition. The liquid carrier may constitute about 90% to 99.5% by weight of the LEP ink composition, in some examples 95% to 99% by weight of the LEP ink composition.

The electrophotographic ink composition, when printed on a print substrate, may be substantially free from liquid carrier. In an electrostatic printing process and/or afterwards, the liquid carrier may be removed, e.g. by an electrophoresis processes during printing and/or evaporation, such that substantially just solids are transferred to the print substrate. Substantially free from liquid carrier may indicate that the ink printed on the print substrate contains less than 5 wt % liquid carrier, in some examples, less than 2 wt % liquid carrier, in some examples less than 1 wt % liquid carrier, in some examples less than 0.5 wt % liquid carrier. In some examples, the ink printed on the print substrate is free from liquid carrier.

Pigment

The LEP ink (pigmented LEP ink) may include a colourant. The colorant may be a dye or pigment. The colorant can be any colorant compatible with the liquid carrier and useful for electrophotographic printing. For example, the colorant may be present as pigment particles, or may comprise a resin (in addition to the polymers described herein) and a pigment. The resins and pigments can be any of those standardly used in the art. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YEL- LOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL L; pigments by DuPont including TIPURE® R-101; and pigments by Paul Uhlich including UHLICH® BK 8200. Where the pigment is a white pigment particle, the pigment particle may be selected from the group consisting of $TiO_2$, calcium carbonate, zinc oxide, and mixtures thereof. In some examples the white pigment particle may comprise an alumina-$TiO_2$ pigment.

The colorant or pigment particle may be present in the LEP ink composition in an amount of from 10 wt % to 80 wt % of the total amount of resin and pigment, in some examples 15 wt % to 80 wt %, in some examples 15 wt % to 60 wt %, in some examples 15 wt % to 50 wt %, in some examples 15 wt % to 40 wt %, in some examples 15 wt % to 30 wt % of the total amount of resin and colorant. In some examples, the colorant or pigment particle may be present in the LEP ink in an amount of at least 50 wt % of the total amount of resin and colorant or pigment, for example at least 55 wt % of the total amount of resin and colorant or pigment.

Charge Director

In some examples, the LEP ink composition includes a charge director. The charge director may be added to an electrophotographic ink composition in order to impart and/or maintain sufficient electrostatic charge on the ink particles. In some examples, the charge director may comprise ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of sulfonic acid. The sulfonic acids may include, but are not limited to, alkyl sulfonic acids, aryl sulfonic acids, and sulfonic acids of alkyl succinates. The charge director can impart a negative charge or a positive charge on the resin-containing particles of an electrophotographic ink composition.

The charge director may be added in order to impart and/or maintain sufficient electrostatic charge on the ink particles, which may be particles comprising the resin.

In some examples, the electrophotographic ink composition comprises a charge director comprising a simple salt. The ions constructing the simple salts are all hydrophilic. The simple salt may include a cation selected from the group consisting of Mg, Ca, Ba, $NH_4$, tert-butyl ammonium, $Li^+$, and $Al^{+3}$, or from any sub-group thereof. The simple salt may include an anion selected from the group consisting of $SO_4^{2-}$, $PO^{3-}$, $NO_3^-$, $HPO_4^{2-}$, $CO_3^{2-}$, acetate, trifluoroacetate (TFA), $Cl^-$, $BF_4^-$, $F^-$, $ClO_4^-$, and $TiO_3^{4-}$ or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiCO_4$ and $LiBF_4$, or any sub-group thereof.

In some examples, the electrophotographic ink composition comprises a charge director comprising a sulfosuccinate salt of the general formula MAn, wherein M is a metal, n is the valence of M, and A is an ion of the general formula (I): $[R^1—O—C(O)CH_2CH(SO_3)C(O)—O—R^2]$, wherein each of $R^1$ and $R^2$ is an alkyl group. In some examples each of $R_1$ and $R_2$ is an aliphatic alkyl group. In some examples, each of $R_1$ and $R_2$ independently is a C6-25 alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$. In some examples, M is Na, K, Cs, Ca, or Ba.

In some examples, the charge director comprises at least one micelle forming salt and nanoparticles of a simple salt as described above. The simple salts are salts that do not form micelles by themselves, although they may form a core for micelles with a micelle forming salt. The sulfosuccinate salt of the general formula MAn is an example of a micelle forming salt. The charge director may be substantially free of an acid of the general formula HA, where A is as described above. The charge director may include micelles of said sulfosuccinate salt enclosing at least some of the nanoparticles of the simple salt. The charge director may include at least some nanoparticles of the simple salt having a size of 200 nm or less, and/or in some examples 2 nm or more.

The charge director may include one of, some of or all of (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

In some examples, the charge director constitutes about 0.001% to 20%, in some examples 0.01% to 20% by weight, in some examples 0.01 to 10% by weight, in some examples 0.01% to 1% by weight of the solids of an electrophotographic ink composition. In some examples, the charge director constitutes about 0.001% to 0.15% by weight of the solids of the electrophotographic ink composition, in some examples 0.001% to 0.15%, in some examples 0.001% to 0.02% by weight of the solids of an electrophotographic ink composition, in some examples 0.1% to 2% by weight of the solids of the electrophotographic ink composition, in some examples 0.2% to 1.5% by weight of the solids of the electrophotographic ink composition in some examples 0.1% to 1% by weight of the solids of the electrophotographic ink composition, in some examples 0.2% to 0.8% by weight of the solids of the electrophotographic ink composition.

In some examples, the charge director is present in an amount of from 3 mg/g to 20 mg/g, in some examples from 3 mg/g to 15 mg/g, in some examples from 10 mg/g to 15 mg/g, in some examples from 5 mg/g to 10 mg/g (where mg/g indicates mg per gram of solids of the electrophotographic ink composition).

Other Additives

The electrophotographic ink composition may include another additive or a plurality of other additives. The other additive or plurality of other additives may be added at any stage of the method. The other additive or plurality of other additives may be selected from a charge adjuvant, a wax, a surfactant, viscosity modifiers, and compatibility additives. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the ink film to the print substrate, e.g. from an intermediate transfer member, which may be a heated blanket.

In some examples, the electrophotographic ink composition includes a charge adjuvant. A charge adjuvant may promote charging of the particles when a charge director is present. The method as described herein may involve adding a charge adjuvant at any stage. The charge adjuvant can include, for example, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an example, the charge adjuvant is or includes aluminum di- or tristearate. In some examples, the charge adjuvant is VCA (an aluminium tristearate and palmitate salt, available from Sigma Aldrich).

The charge adjuvant may be present in an amount of about 0.1 to 5% by weight, in some examples about 0.1 to 1% by weight, in some examples about 0.3 to 0.8% by weight of the solids of the electrophotographic ink composition, in some examples about 1 wt % to 3 wt % of the solids of the electrophotographic ink composition, in some examples about 1.5 wt % to 2.5 wt % of the solids of the electrophotographic ink composition.

The charge adjuvant may be present in an amount of less than 5.0% by weight of total solids of the electrophotographic ink composition, in some examples in an amount of less than 4.5% by weight, in some examples in an amount of less than 4.0% by weight, in some examples in an amount of less than 3.5% by weight, in some examples in an amount of less than 3.0% by weight, in some examples in an amount of less than 2.5% by weight, in some examples about 2.0% or less by weight of the solids of the electrophotographic ink composition.

In some examples, the electrophotographic ink composition further includes, e.g. as a charge adjuvant, a salt of multivalent cation and a fatty acid anion. The salt of multivalent cation and a fatty acid anion can act as a charge adjuvant. The multivalent cation may, in some examples, be a divalent or a trivalent cation. In some examples, the multivalent cation is selected from Group 2, transition metals and Group 3 and Group 4 in the Periodic Table. In some examples, the multivalent cation includes a metal selected from Ca, Sc, Ti, V, Cr, Mn, Fe, Co, Ni, Cu, Zn, Al and Pb. In some examples, the multivalent cation is $Al^{3+}$. The fatty acid anion may be selected from a saturated or unsaturated fatty acid anion. The fatty acid anion may be selected from a $C_8$ to $C_{26}$ fatty acid anion, in some examples a $C_{14}$ to $C_{22}$ fatty acid anion, in some examples a $C_{16}$ to $C_{20}$ fatty acid anion, in some examples a $C_{17}$, $C_{18}$ or $C_{19}$ fatty acid anion. In some examples, the fatty acid anion is selected from a caprylic acid anion, capric acid anion, lauric acid anion, myristic acid anion, palmitic acid anion, stearic acid anion, arachidic acid anion, behenic acid anion and cerotic acid anion.

The charge adjuvant, which may, for example, be or include a salt of a multivalent cation and a fatty acid anion, may be present in an amount of 0.1 wt % to 5 wt % of the solids of the electrophotographic ink composition, in some examples in an amount of 0.1 wt % to 2 wt % of the solids of the electrophotographic ink composition, in some examples in an amount of 0.1 wt % to 2 wt % of the solids of the electrophotographic ink composition, in some examples in an amount of 0.3 wt % to 1.5 wt % of the solids of the electrophotographic ink composition, in some examples about 0.5 wt % to 1.2 wt % of the solids of the electrophotographic ink composition, in some examples about 0.8 wt % to 1 wt % of the solids of the electrophotographic ink composition, in some examples about 1 wt % to 3 wt % of the solids of the electrophotographic ink composition, in some examples about 1.5 wt % to 2.5 wt % of the solids of the electrophotographic ink composition.

Method for Producing an Electrophotographic Ink Composition

Also provided is a method of producing a LEP ink composition, the method comprising combining a carrier liquid and a resin to form a mixture, the resin comprising an acid copolymer and an acrylate copolymer as described herein.

In some examples, the method comprises grinding the mixture comprising the resin and the carrier liquid.

In some examples, the mixture comprises greater than about 20 wt. % resin, for example at least about 25 wt. % resin, about 30 wt. % resin or more, for example about 35 wt. % resin. In some examples, the mixture comprises less than about 40 wt. % resin, for example less than about 35 wt. % resin. In some examples, the mixture comprises from about 20 wt. % to about 35 wt. % resin.

In some examples, the mixture comprises greater than about 25 wt. % non-volatile solids (NVS), for example, about 30 wt. % NVS or more, for example, about 35 wt. % NVS or more. The non-volatile solids may comprise a resin as defined herein. In some examples, the non-volatiles solids comprises a resin, a pigment, a charge adjuvant, or combinations thereof.

In some examples, the mixture comprises less than about 40 wt. % NVS. In some examples, the mixture comprises 25 wt. % to 35 wt. % NVS, for example, 30 wt. % to 35 wt. %.

Printing Process and Print Substrate

Also provided is a method of electrostatic printing, the method including:

providing a liquid electrophotographic ink composition as described herein, contacting the liquid electrophotographic ink composition with a latent electrostatic image on a surface to create a developed image, transferring the developed image to a print substrate, in some examples via an intermediate transfer member.

In some examples, the surface on which the (latent) electrostatic image is formed or developed may be on a rotating member, e.g. in the form of a cylinder. The surface on which the (latent) electrostatic image is formed or developed may form part of a photo imaging plate (PIP). The method may involve passing the electrophotographic ink composition between a stationary electrode and a rotating member, which may be a member having the surface having the (latent) electrostatic image thereon or a member in contact with the surface having the (latent) electrostatic image thereon. A voltage is applied between the stationary electrode and the rotating member, such that particles adhere to the surface of the rotating member. The intermediate transfer member, if present, may be a rotating flexible member, which may be heated, e.g. to a temperature of from 80 to 160° C.

Also provided is a print substrate having printed thereon a LEP ink composition as described herein and/or producible according to the method described herein.

The print substrate may be any suitable substrate. The substrate may be any suitable substrate capable of having an image printed thereon. The substrate may include a material selected from an organic or inorganic material. The material may include a natural polymeric material, e.g. cellulose. The material may include a synthetic polymeric material, e.g. a polymer formed from alkylene monomers, including, for example, polyethylene and polypropylene, and co-polymers such as styrene-polybutadiene. The polypropylene may, in some examples, be biaxially orientated polypropylene. The material may include a metal, which may be in sheet form. The metal may be selected from or made from, for instance, aluminium (Al), silver (Ag), tin (Sn), copper (Cu), mixtures thereof. In an example, the substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, a primer may be coated onto the print substrate, before the electrophotographic ink composition is printed onto the print substrate.

FIG. 1 shows a schematic illustration of a Liquid Electro Photographic (LEP) printing apparatus which may be used to print an electrophotographic ink composition as described herein. An image, including any combination of graphics, text and images, may be communicated to the LEP printing apparatus 1. According to an illustrative example, in order to print the electrophotographic ink composition, firstly, the photo charging unit 2 deposits a uniform static charge on the photo-imaging cylinder 4 and then a laser imaging portion 3 of the photo charging unit 2 dissipates the static charges in selected portions of the image area on the photo-imaging cylinder 4 to leave a latent electrostatic image. The latent electrostatic image is an electrostatic charge pattern representing the image to be printed. The electrophotographic ink composition is then transferred to the photo-imaging cylinder 4 by Binary Ink Developer (BID) unit 6. The BID unit 6 present a uniform film of the electrophotographic ink composition to the photo-imaging cylinder 4. A resin component of the electrophotographic ink composition may be electrically charged by virtue of an appropriate potential applied to the electrophotographic ink composition in the BID unit. The charged resin component which, by virtue of an appropriate potential on the electrostatic image areas, is attracted to the latent electrostatic image on the photo-imaging cylinder 4 (first transfer). The electrophotographic ink composition does not adhere to the uncharged, non-image areas and forms an image on the surface of the latent electrostatic image. The photo-imaging cylinder 4 then has a developed electrophotographic ink composition image on its surface.

The image is then transferred from the photo-imaging cylinder 4 to the intermediate transfer member (ITM) 8 by virtue of an appropriate potential applied between the photo-imaging cylinder 4 and the ITM 8, such that the charged electrophotographic ink composition is attracted to the ITM 8 (second transfer). The image is then dried and fused on the ITM 8 before being transferred to a print substrate 10.

Between the first and second transfers the solid content of the electrophotographic ink composition image is increased and the electrophotographic ink composition is fused on to the ITM 8. For example, the solid content of the electrophotographic ink composition image deposited on the ITM 8 after the first transfer is typically around 20%, by the second transfer the solid content of the image is typically around 80-90%. This drying and fusing is typically achieved by using elevated temperatures and air flow assisted drying. In some examples, the ITM 8 is heatable.

Examples

The following illustrates examples of the compositions and related aspects described herein. Thus, these examples should not be considered to restrict the present disclosure, but are merely in place to teach how to make examples of compositions of the present disclosure.

Materials

Resins:

Nucrel® 699 (Dupont): a copolymer of ethylene and methacrylic acid, made with nominally 11 wt. % methacrylic acid (abbreviation: F).

AC-5120 (Honeywell): ethylene-acrylic acid copolymer with an acid number of 112-130 KOH/g (abbreviation: ACE).

Elvaloy® AC 34035 (Dupont): a copolymer of ethylene and butyl acrylate, made with 35 wt. % butyl acrylate co-monomer content and contains a slip additive (abbreviation: ELV35).

Elvaloy® AC 3427 (Dupont): a copolymer of ethylene and butyl acrylate, made with 27 wt. % butyl acrylate co-monomer (abbreviation: ELV34).

Elvaloy® AC 12024S (Dupont): a copolymer of ethylene and methyl acrylate, made with 24 wt. % methyl acrylate and contains an antioxidant additive (abbreviation: ELV12).

Lotader® AX8900 (Arkema): a random terpolymer of ethylene, acrylic ester and glycidyl methacrylate (epoxide function), made with 24 wt. % methyl acrylate and 8 wt. % glycidyl methacrylate (abbreviation: AX9).

Carrier Liquid

Isopar L (available form EXXON): an isoparafinic oil (the carrier liquid).

Charge Adjuvant

VCA (an aluminium tristearate and palmitate salt, available from Sigma Aldrich)

Charge Director

NCD: a natural charge director having the components (i) natural soya lecithin, (ii) basic barium petronate, and (iii) dodecyl benzene sulphonic acid, amine salt, with the components (i), (ii) and (iii) being present in the weight ratios of 6.6%:9.8:3.6%.

General Procedure

A transparent paste (40 wt. % non-volatile solids (NVS)) was formed by combining a resin with Isopar® L in a Ross reactor (Model DPM-2, obtained from Charles Ross & Son Company-Hauppauge NY) at 130° C. and a mixing rate of 50 rpm for 1 h. The mixing rate was then increased to 70 rpm and mixing was continued at 130° C. for a further 1.5 h. The temperature was then gradually reduced to 25° C. over at least 2.5 h under continued mixing at 70 rpm to form the transparent paste.

The transparent paste was then diluted with further Isopar® L and ground with a black pigment (20.3 wt. % of the total solids; a mixture of Monarch 800 (which is pigment black 7, a carbon black pigment available from Cabot) and FB55 (which is Pigment Blue 61, available form Flint group)) for 12 h in the presence of VCA (1.2 wt. % of total solids) in an SS attritor at 58° C. and 250 rpm for 1 h, and then at 36° C. and 250 rpm for 10.5 h forming a liquid electrophotographic ink composition.

Table of Examples

| | Resin | | | | | | | |
|---|---|---|---|---|---|---|---|---|
| | F | ACE | Acrylate copolymer | | | Can | Tube | Viscosity |
| Example | [wt. % of total resin] | [wt. % of total resin] | | [wt. % of total resin] | Grinding wt. % NVS | storage wt. % NVS | storage wt. % NVS | (measured at 8.4 wt. % NVS) [cP] |
| Ref. 1 | 80 | 20 | — | — | 30 | — | — | 221.1 |
| (EI4.5[1]) | | | | | 23 | 23 | 35 | — |
| | | | | | 20 | — | — | 160-200 |
| Ref. 2 | 78.4 | 19.6 | AX9 | 2 | 30 | — | — | 41 |
| | 75.2 | 18.8 | | 6 | 30 | — | — | 123 |
| | | | | | 20 | | | 160 |
| | 72 | 18 | | 10 | 30 | — | — | 50.6 |
| | | | | | 20 | — | — | 118.7 |
| Ref. 3 | 78.4 | 19.6 | ELV12 | 2 | 30 | — | — | 115 |
| | 73.6 | 18.4 | | 8 | 30 | — | — | 14.2 |
| Ref. 4 | 78.4 | 19.6 | ELV34 | 2 | 30 | — | — | 120 |
| | 76.8 | 19.2 | | 4 | 30 | — | — | 19 |
| | 75.2 | 18.8 | | 6 | 30 | — | — | 36.5 |
| | 72 | 18 | | 10 | 20[2] | — | — | 11.2 |
| Ex. 1 | 79.2 | 19.8 | ELV35 | 1 | 30 | — | — | 46 |
| | 77.6 | 19.4 | | 3 | 35 | 35 | 42 | — |
| | | | | | 30 | — | — | 11.56 |
| | 75.2 | 18.8 | | 6 | 30 | — | — | 4.64 |

[1]EI4.5 = HP ElectroInk ® 4.5;

[2]A lower weight percentage non-volatile solids was used for grinding when 10 wt. % ELV34 was used because the composition could not be ground at 30 wt. % NVS.

The ink was then stored in a can or was concentrated by centrifuge for storage in a tube.

For liquid electrophotographic printing, the electrophotographic ink composition was then diluted to 2 wt. % solids. A charge director (NCD, estimated 100 mg per 1 g ink) was added to the 2 wt. % composition on the printing press to produce a printable ink.

Tests

Viscosity

Liquid electrophotographic ink compositions prepared according to the General Procedure above were diluted to 8.4 wt. % NVS with Isopar® before the dynamic viscosity was measured. The viscosity (dynamic viscosity) was measured using an AR-2000 model Rheometer from TAI (Thermal Analysis Instruments). A continuous random ramp shear rate of 0.1 $s^{-1}$ to 3000 $s^{-1}$ was applied at a temperature of 25° C. and measurements were taken at a shear rate of approximately 11 $s^{-1}$.

Results are provided in the Table of Examples above. Ink compositions in which the resin comprised an acrylate copolymer of an alkylene monomer and an alkyl (meth) acrylate monomer in which the alkyl (meth)acrylate monomer was present in an amount of at least about 30 wt. % (for example, ELV35) show a significantly reduced viscosity in comparison to ink compositions not containing an acrylate copolymer (for example, Ref. 1 (E14.5)). Additionally, ink compositions in which the resin comprised an acrylate copolymer as defined herein in which the alkyl (meth) acrylate monomer was present in an amount of at least about 30 wt. % (for example, ELV35) show a reduced viscosity in comparison to ink compositions in which the resin comprises an acrylate polymer in which the alkyl (meth)acrylate monomer was present in less than 30 wt. % (for example, ELV27 and ELV12).

Extraction Test

Figure 3:
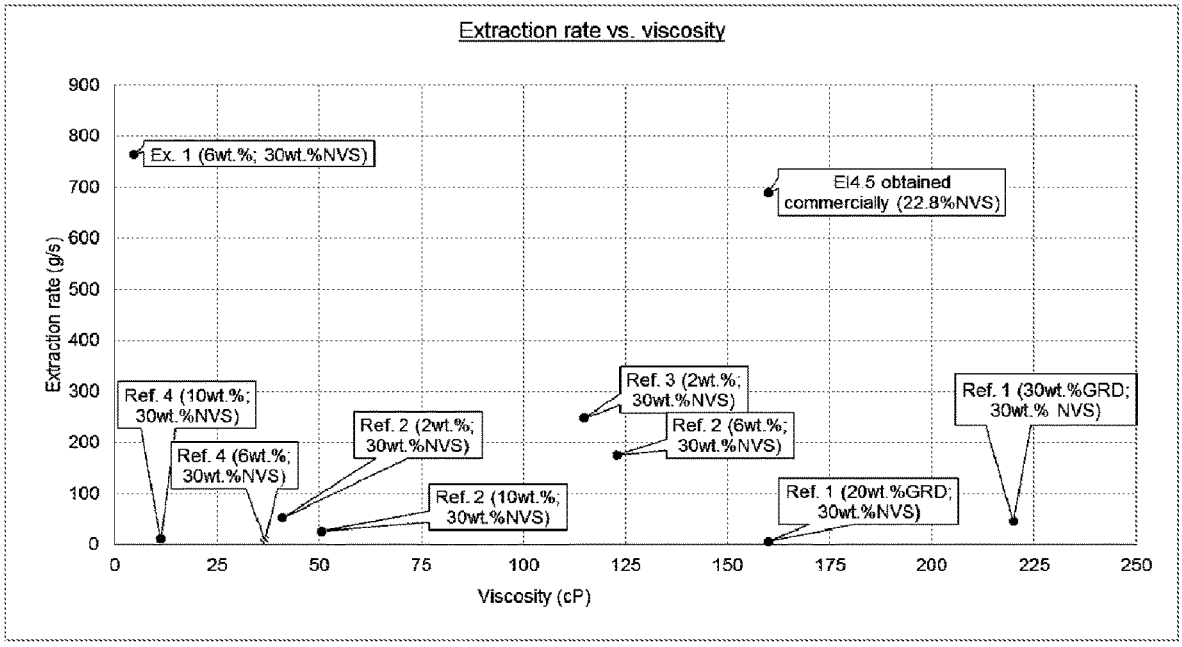
FIG. 3 is a graph showing the extraction rate vs. viscosity for various liquid electrophotographic ink compositions.

Liquid electrophotographic ink compositions were placed in an ink can (an HP Indigo ElectroInk 4.5 can) at 30 wt. % NVS (unless specified otherwise in FIG. 3). The ink was extracted from the can by applying a pressure of 1.2 to 1.6 bar. The flow rate of the liquid electrophotographic ink composition from the can was determined.

FIG. 3 shows the extraction rate of the ink compositions against the viscosity of these compositions when diluted to 8.4 wt. % NVS. As shown in FIG. 3, although resins containing an acrylate copolymer with less than 30 wt. % alkyl (meth)acrylate monomer reduce the viscosity of the ink compositions, compared to compositions containing no acrylate copolymer, the inclusion of an acrylate copolymer as defined herein surprisingly also provided an ink composition exhibiting a vastly improved extraction rate. For example, the extraction rate of electrophotographic inks including ELV35 (Ex. 1) at 30 wt. % NVS is improved compared to that of an electrophotographic ink composition containing no acrylate copolymer and greater NVS content (E14.5 at 22.8 wt. % NVS). The extraction rate of electrophotographic inks including ELV34 (Ref. 4), ELV12 (Ref. 3) and AX9 (Ref. 2) at 30 wt. % NVS is significantly lower than that of electrophotographic ink compositions including an acrylate copolymer as defined herein (e.g. ELV35) even though the viscosities of the reference compositions are reduced compared to compositions comprising no acrylate copolymer.

Rub Resistance Test

Liquid electrophotographic inks prepared according to the general procedure above were electrostatically printed (by an HP Indigo 7000 LEP printer) onto coated paper (UPM Fine) and uncoated paper (UPM Finesse) to form printed substrates, which were then placed in a Sutherland Rub Tester. The rub test was performed according to ASTM D5264-98. The tested samples were then inspected visually and optical density measurements were performed to evaluate the amount of ink removed from the printed substrates.

Liquid electrophotographic inks containing a resin comprising an acrylate copolymer containing at least 30 wt. % of an alkyl (meth)acrylate monomer were found to perform better in rub tests than electrophotographic inks without an acrylate copolymer. In contrast, liquid electrophotographic inks containing a resin comprising an acrylate copolymer containing less than 30 wt. % of an alkyl (meth)acrylate monomer were found to perform worse in rub tests than electrophotographic inks without an acrylate copolymer. For example, liquid electrophotographic inks according to Reference Example 3 (containing ELV12; 2 wt. % by total resin content) perform slightly worse than Reference Example 1 (E14.5) in the rub tests. Liquid electrophotographic inks according to Reference Example 4 (containing ELV34; 2 wt. % and 6 wt. % by total resin content) perform worse than Reference Example 1 (E14.5) in the rub tests, resulting in removal of approximately 10% (2 wt. % ELV34) and 30% (6 wt. % ELV34) more ink. By contrast, liquid electrophotographic inks according to Example 1 (containing ELV35; 1 wt. % and 3 wt. % by total resin content) perform better than Reference Example 1 (E14.5) in the rub tests, resulting in removal of approximately 6% (1 wt. % ELV35) and approximately 7.5% (3 wt. % ELV 35) less ink.

While the liquid electrophotographic ink compositions, methods and related aspects have been described with reference to certain examples, it will be appreciated that various modifications, changes, omissions, and substitutions can be made without departing from the spirit of the disclosure. It is intended, therefore, that the electrophotographic ink compositions, methods and related aspects be limited only by the scope of the following claims. Unless otherwise stated, the features of any dependent claim can be combined with the features of any of the other dependent claims, and any other independent claim.

The invention claimed is:

1. A liquid electrophotographic ink composition comprising:

a carrier liquid; and a resin comprising:

an acid copolymer of an alkylene monomer and a monomer having an acid side group, wherein the acid copolymer is absent of ester groups; and at least about 0.1 wt. % by total weight of the resin being an acrylate copolymer of an alkylene monomer and an alkyl (meth)acrylate monomer, the acrylate copolymer consisting of 35 wt. % to 50 wt. % of the alkyl (meth)acrylate monomer, with a remaining component of the acrylate copolymer consisting of the alkylene monomer.

2. The liquid electrophotographic ink composition according to claim 1, wherein the resin comprises at least about 50 wt. % of the acid copolymer by total weight of the resin.

3. The liquid electrophotographic ink composition according to claim 1, wherein the alkyl (meth)acrylate monomer is a C1-C10 alkyl (meth)acrylate monomer.

4. The liquid electrophotographic ink composition according to claim 3, wherein the alkyl (meth)acrylate monomer is a C1, C2, C3, C4, C5, or C6 alkyl (meth) acrylate monomer.

5. The liquid electrophotographic ink composition according to claim 1, wherein the acrylate copolymer is a copolymer of ethylene and butyl acrylate.

6. The liquid electrophotographic ink composition according to claim 5, wherein the acrylate copolymer comprises about 35 wt. % butyl acrylate.

7. The liquid electrophotographic ink composition according to claim 1, wherein the resin comprises at least about 1 wt. % of the acrylate copolymer by total weight of the resin.

8. The liquid electrophotographic ink composition according to claim 1, wherein the resin comprises up to about 10 wt. % of the acrylate copolymer by total weight of the resin.

9. The liquid electrophotographic ink composition according to claim 1, wherein the monomer having an acid side group is a (meth)acrylic acid monomer.

10. A method of producing a liquid electrophotographic ink composition, the method comprising combining a carrier liquid and a resin to form a mixture, the resin comprising:

an acid copolymer of an alkylene monomer and a monomer having an acid side group, wherein the acid copolymer is absent of ester groups; and at least about 0.1 wt. % by total weight of the resin being an acrylate copolymer of an alkylene monomer and an alkyl (meth)acrylate monomer, the acrylate copolymer consisting of 35 wt. % to 50 wt. % of the alkyl (meth)acrylate monomer, with a remaining component of the acrylate copolymer consisting of the alkylene monomer.

11. The method according to claim 10 comprising grinding the mixture.

12. The method according to claim 11, wherein the mixture contains greater than about 25 wt. % resin.

13. A printed substrate comprising:

a print substrate; and a liquid electrophotographically printed image layer comprising a resin that includes:

an acid copolymer of an alkylene monomer and a monomer having an acid side group, wherein the acid copolymer is absent of ester groups; and at least about 0.1 wt. % by total weight of the resin being an acrylate copolymer of an alkylene monomer and an alkyl (meth)acrylate monomer, the acrylate copolymer consisting of 35 wt. % to 50 wt. % of the alkyl (meth)acrylate monomer, with a remaining component of the acrylate copolymer consisting of the alkylene monomer.

* * * * *